US009440453B2

(12) United States Patent
Cohen et al.

(10) Patent No.: US 9,440,453 B2
(45) Date of Patent: Sep. 13, 2016

(54) EMBOSSING APPARATUS

(71) Applicant: HEWLETT-PACKARD INDIGO B.V., Amstelveen (NL)

(72) Inventors: Zvika Cohen, Givat berener (IL); Eyal Peleg, Zoran (IL); Shahar Stein, Zur Yizhak (IL); Itzik Shaul, Nes Ziona (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 19 days.

(21) Appl. No.: 14/631,378

(22) Filed: Feb. 25, 2015

(65) Prior Publication Data

US 2015/0174915 A1 Jun. 25, 2015

Related U.S. Application Data

(63) Continuation of application No. 13/363,164, filed on Jan. 31, 2012, now Pat. No. 9,056,520.

(51) Int. Cl.

| | |
|---|---|
| ***B41J 3/38*** | (2006.01) |
| ***B44B 5/02*** | (2006.01) |
| *B41M 3/16* | (2006.01) |
| *B41F 19/02* | (2006.01) |
| *B41F 19/06* | (2006.01) |

(52) U.S. Cl.

CPC .. *B41J 3/38* (2013.01); *B44B 5/02* (2013.01); *B41F 19/02* (2013.01); *B41F 19/06* (2013.01); *B41M 3/16* (2013.01)

(58) Field of Classification Search

CPC ..... B41F 19/02; B41F 19/06; B41M 3/16
See application file for complete search history.

(56) References Cited

U.S. PATENT DOCUMENTS

| | | | | |
|---|---|---|---|---|
| 4,671,538 | A | 6/1987 | Calman | |
| 4,766,811 | A | 8/1988 | Linska | |
| 5,336,585 | A * | 8/1994 | Takahashi | G03F 7/027 430/18 |
| 5,407,771 | A | 4/1995 | Landa et al. | |
| 5,554,476 | A | 9/1996 | Landa et al. | |
| 7,078,141 | B2 | 7/2006 | Ben-Avraham et al. | |
| 7,400,850 | B2 * | 7/2008 | Romem | G03G 15/161 399/296 |
| 7,419,766 | B2 * | 9/2008 | Kimelblat | B41N 1/12 101/453 |
| 7,977,023 | B2 | 7/2011 | Roditi et al. | |
| 2008/0121123 | A1 | 5/2008 | Gebhardt | |

(Continued)

FOREIGN PATENT DOCUMENTS

| | | |
|---|---|---|
| EP | 2199065 A1 | 6/2010 |
| EP | 2412516 A2 | 2/2012 |

*Primary Examiner* — Blake A Tankersley
*Assistant Examiner* — Quang X Nguyen
(74) *Attorney, Agent, or Firm* — Fabian VanCott

(57) ABSTRACT

An embossing apparatus comprises an embossing die comprising a printed relief pattern, and a resilient surface for pressing media against the embossing die to emboss features corresponding to the printed relief pattern on the media, in which the printed relief pattern comprises a number of layers of a deposited material, and in which a number of layers of the deposited material closest to the top of the printed relief pattern comprises a deposited material with a relatively lower coefficient of adhesion than layers of the deposited material disposed under the deposited material closest to the top of the printed relief pattern. A printed relief pattern for embossing media comprises a number of preliminary layers, the preliminary layers comprising a first material, and a number of terminal layers, the terminal layers comprising a second material, in which the second material has a lower adhesive coefficient than the first material.

20 Claims, 7 Drawing Sheets

(56) References Cited

U.S. PATENT DOCUMENTS

2009/0091591 A1* 4/2009 Sivan ..... B41M 3/16 347/9
2011/0195266 A1 8/2011 Spoto
2011/0249048 A1 10/2011 Gullentops
2014/0083315 A1 3/2014 Sandler

* cited by examiner

EMBOSSING APPARATUS

BACKGROUND

Embossing is used to create raised images and designs in printed paper or other printed media. Embossing is performed as a post printing process on dedicated embossing machinery. Embossing machines involve the design and manufacture of a two piece die. The embossing machines place a portion of the media between the two pieces and then press the two pieces of the die together. This mechanically deforms the media to create the embossed image. These embossing techniques may have a number of disadvantages, including the delay in manufacturing the die, the cost of purchasing/maintaining separate embossing machines, and the significant amount of effort involved in a separate post-printing embossing run.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Figure 1:
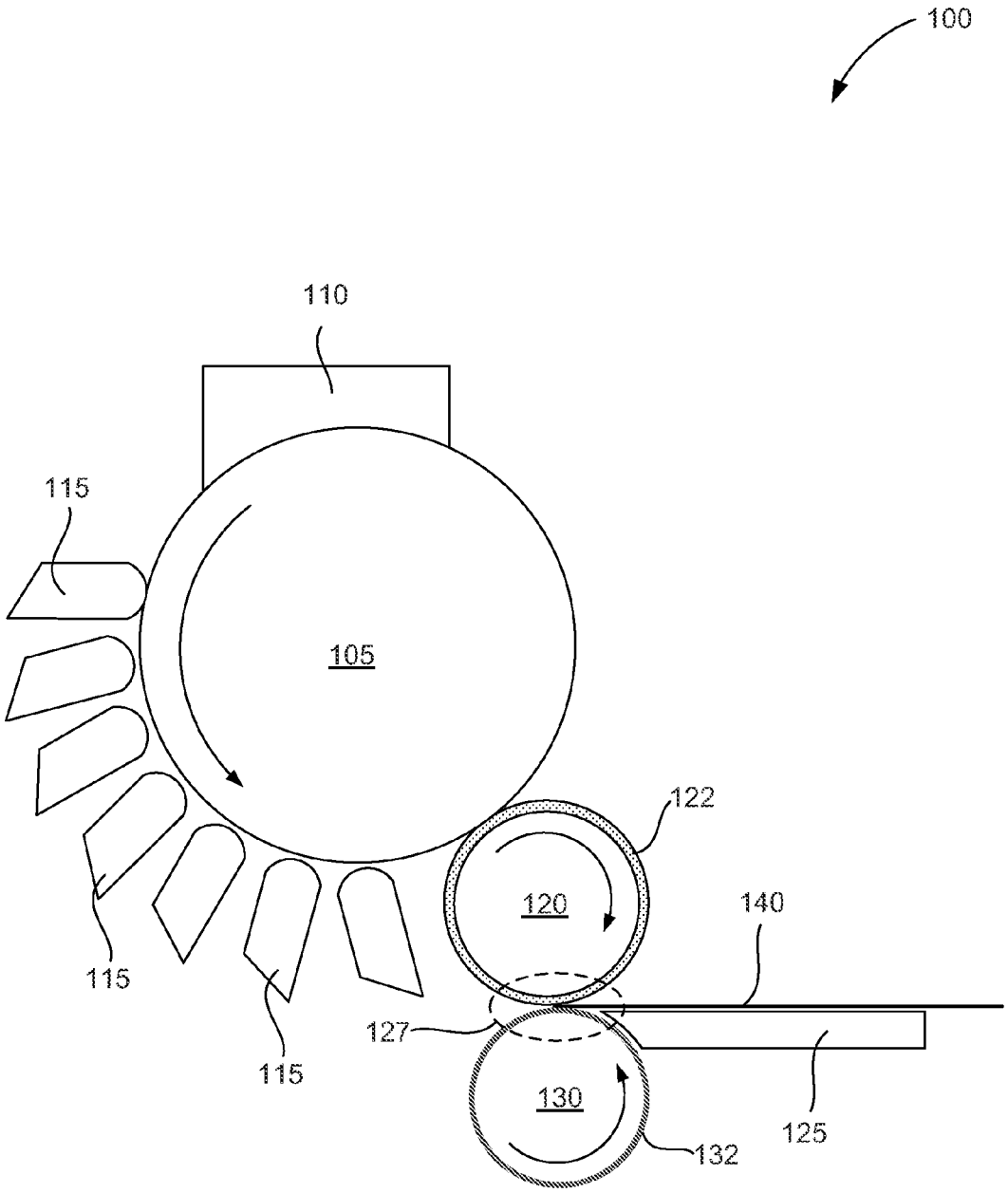
FIG. 1 is a diagram of a digital Liquid Electro Photographic (LEP) printing system, according to one example of principles described herein.

Embossing is used to create raised images and designs in printed paper or other printed media. These raised images provide texture, emphasis, and visual effects to the media. The embossed images can include a variety of additional characteristics, including, for example, printed images, gloss, lamination, or security features. However, once a printed relief pattern is created in order to form embossed features on print media, a jam may occur within the printing device due to the continued adhesion of the print media to the printed relief pattern. The present disclosure discloses a system and method of eliminating or reducing media jams within a printing device that utilizes a printed relief pattern.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with the example is included in at least that one example, but not necessarily in other examples.

The examples and methods described below provide for embossing of a wide range of printable media. In one example, printed relief patterns are used to form the embossing die. The printed relief pattern can be formed using a variety of printing processes and, in some examples, can be printed by the same printer that forms ink images on the media. The media is pressed against the printed relief patterns to form the embossed image in the media. This process is integrated into a printing flow within the printer. This eliminates delay, handling, and overhead of traditional embossing systems.

As used in the specification and appended claims, the term "printed relief pattern" refers to ink structures having a thickness or height sufficient to emboss a media pressed against the printed relief pattern. In one example, a printed relief pattern may have a height of between approximately 0.1 millimeters and 2 millimeters or more. In some examples, the printed relief pattern may be formed from multiple layers of ink. Factors which may influence the height of printed relief pattern include: the desired height of the embossed image, the capacity of the printing technique in depositing ink layers, and the structural characteristics of the cured ink.

As used in the specification and appended claims, the term "ink" refers broadly to material deposited onto a surface by a printer or press. For example, the term "ink" includes liquid toners, dry toners, UV cured inks, thermally cured inks, inkjet inks, pigment inks, dye based inks, solutions without colorant, solvent-based inks, water based inks, plastisols, or combinations thereof.

Still further, as used in the present specification and in the appended claims, the term "deposited material" or similar language is meant to be understood broadly as any material that may be deposited on a surface to form an embossing die. In one example, the material comprises a number of inks. The inks may be deposited alone or in as a combination of inks to form different portions of the embossing die. Further, the material is any material that may be used in a printing system or apparatus.

Even still further, as used in the present specification and in the appended claims, the term "a number of" or similar language is meant to be understood broadly as any positive number comprising 1 to infinity; zero not being a number, but the absence of a number.

In some examples, the printed relief patterns are created using digital printing processes. Digital printing processes transform digital data into a printed image. Additionally, digital printing allows for successive images to change without slowing or reconfiguring the printer. Thus, the ink layers that make up the printed relief patterns can be rapidly formed in any pattern described by the digital data. The cost of printed relief patterns correlates to the cost of operating the printing press for tens of seconds and the amount of ink contained in the printed relief pattern. This can be a significant cost savings over designing a brass, bronze or copper embossing die, sending out the die for machining, waiting to receive the die from the machinist, installing the die in a dedicated embossing machine, and managing the post-printing embossing run. Consequently, the use of printed relief patterns as embossing die can enable low cost, rapid embossing runs that occur during a printing workflow.

The digital embossing technique can be performed using a number of printing technologies, including Liquid Electro Photographic (LEP) printing, xerography, and inkjet printing. The term "Liquid Electro Photographic" or "LEP" refers to a process of printing in which a liquid toner is applied through an electric field onto a surface to form an electrostatic pattern. In most LEP processes, this pattern is then transferred to at least one intermediate surface, and then to a print medium. During the operation of a digital LEP system, ink images are formed on the surface of a photo-imaging cylinder. These ink images are transferred to a heated blanket cylinder and then to a print medium. The photo-imaging cylinder continues to rotate, passing through various stations to form the next image.

The term "nip" refers to a region between two rollers where the rollers are in closest proximity. When a media sheet or other material passes through the nip, the distance between the two rollers can be adjusted to produce pressure on the media.

FIG. 1 is a diagram of a digital LEP system (100). A desired image is communicated to the printing system (100) in digital form. The desired image may include any combination of text, graphics, and images. The desired image is initially formed on the photo-imaging cylinder (105), transferred to the blanket cylinder (120), and then transferred to the print medium (140).

According to one example, an image is formed on the photo-imaging cylinder (105) by rotating a clean, bare segment of the photo-imaging cylinder (105) under the photo charging unit (110). The photo charging unit (110) includes a charging device such as corona wire, charge roller, or other charging device and a laser imaging portion. A uniform static charge is deposited on the photo-imaging cylinder (105) by the photo charging unit (110). As the photo-imaging cylinder (105) continues to rotate, it passes the laser imaging portion of the photo charging unit (110) that dissipates the static charges in selected portions of the image area to leave an electrostatic charge pattern that represents the image to be printed.

Ink is transferred onto the photo-imaging cylinder (105) by Binary Ink Developer (BID) units (115). In one example, the digital LEP system (100) may include one BID unit (115) for each ink color. During printing, the appropriate BID unit is engaged with the photo-imaging cylinder (105). The engaged BID unit presents a uniform film of ink to the photo-imaging cylinder (105). The ink contains electrically charged pigment particles that are attracted to the opposing electrical fields on the image areas of the photo-imaging cylinder (105). The ink is repelled from the uncharged, non-image areas. The photo-imaging cylinder (105) now has a single color ink image on its surface.

The photo-imaging cylinder (105) continues to rotate and transfers the ink image to a blanket cylinder (120). The blanket cylinder transfers the image to a sheet of media wrapped around the impression cylinder (130). As will be further described below, this process may be repeated for each of the colored ink layers to be included in a final image.

The print medium (140) enters the printing system (100) from the right, passes over a feed tray (125), and is wrapped onto the impression cylinder (130). As the print medium (140) contacts the blanket cylinder (120), the single color ink image is transferred to the print medium (140).

In one example, the printing process may begin by introducing a sheet of media to the printing device and wrapping the sheet of media around impression cylinder (130) and on top an impression layer (132). Wrapping of the sheet of media around the impression cylinder (130) may include the following. The sheet enters a slot in the impression cylinder (130) called a gripper and then the slot closes, locking the sheet in place around the impression cylinder (130). Wrapping of the sheet of media is performed during rotation of the impression cylinder (130). In this manner, the ration of the impression cylinder (130) resulting in the sheet of media wrapping around the impression cylinder (130). In parallel, the resilient layer (122) on the blanket cylinder (120) receives a layer of ink from the photo-imaging cylinder (105). Once the printing process is completed, the gripper on the impression cylinder (130) opens up and releases the sheet of media.

The creation, transfer, and cleaning of the photo-imaging cylinder (105) is a continuous process, with hundreds of images being created and transferred per minute. As described above, a sheet of media comprising a pre-cut sheet may be introduced to the printing device in order to create a printed sheet. In another example, the present printing system may utilize a webs or rolls of media.

To form a single color image such as a black and white image, one pass of the print medium (140) through the impression cylinder (130) and the blanket cylinder (120) completes the desired image. For a color image, the print medium (140) is retained on the impression cylinder (130) and makes multiple contacts with the blanket cylinder (120) as it passes through the nip (127). At each contact, an additional color plane may be placed on the print medium (140).

For example, to generate a four color image, the photo charging unit (110) forms a second pattern on the photo-imaging cylinder (105) which receives the second ink color from a second BID unit (115). As described above, this second ink pattern is transferred to the blanket cylinder (120) and impressed onto the print medium (140) as it continues to rotate with the impression cylinder (130). This continues until the desired image with all four color planes is formed on the print medium. Following the complete formation of the desired image on the print medium (140), the print medium (140) can exit the machine or be duplexed to create a second image on the opposite surface of the print medium (140). Because the printing system is digital, the operator can change the image being printed at any time and without manual reconfiguration.

According to one example, the digital offset LEP system (100) can be configured to perform embossing in addition to printing. The impression cylinder (130) is covered by an impression layer (132). This impression layer (132) absorbs and captures excess ink to minimize maintenance and image quality issues. For example, when a paper jam occurs, ink intended for the absent paper may be instead deposited on the impression layer (132). As part of the jam clearing process, the operator may replace the impression layer (132) before restarting the printing operation. The printer design facilitates the rapid and convenient replacement of the impression layer (132).

To perform embossing with the digital offset LEP system, feeding of the media through the press (100) is temporarily stopped. Ink, acting as the deposited material in one example, is repeatedly deposited on the impression layer (132) to accumulate and build up a two or three dimensional relief ink image that serves as an embossing die. The ink deposition process occurs as described above, with an electrostatic image being created on the photo-imaging cylinder (105) and the photo-imaging cylinder (105) receiving ink from a BID unit (115) to form an ink image on the photo-imaging cylinder (105). The image is transferred to the surface of the resilient layer (122) on the blanket cylinder (120) and then to the impression layer (132). The ink image is cured on the impression layer (132).

Curing of the ink may be performed in any manner. In one example, during ink deposition, internal and external heat sources heat the ink layer. This results in the ink particles melting and fusing together and further results in the evaporation of a portion of the carrier liquid. In this manner, a tacky ink layer is formed. Once the hot melt image comes into contact with the colder sheet of media, the ink cools and solidifies, and attaches to the surface of the substrate to form a single color image layer. This process is repeated to deposit a number of layers of cured ink and forms the printed relief pattern that serves as the embossing die. In some examples, the formation of the printed relief pattern may pause after the deposition of a number of ink layers or may incorporate null printing cycles where no ink is deposited.

The description of embossing using printed relief patterns created on an LEP printer is an example. A variety of other printing methods and systems could be used to create printed relief patterns and emboss media. Additional examples are described below.

Figure 2A:
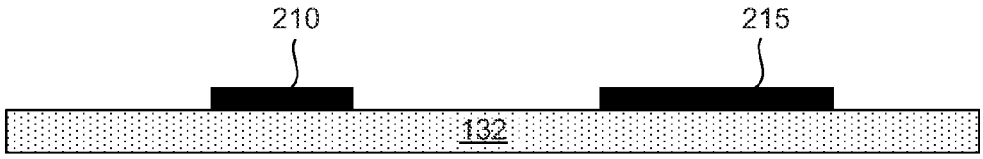
FIG. 2A-2D are cross sectional diagrams of an embossing process which uses a printed relief pattern as an embossing die, according to one example of principles described herein.
Figure 2B:
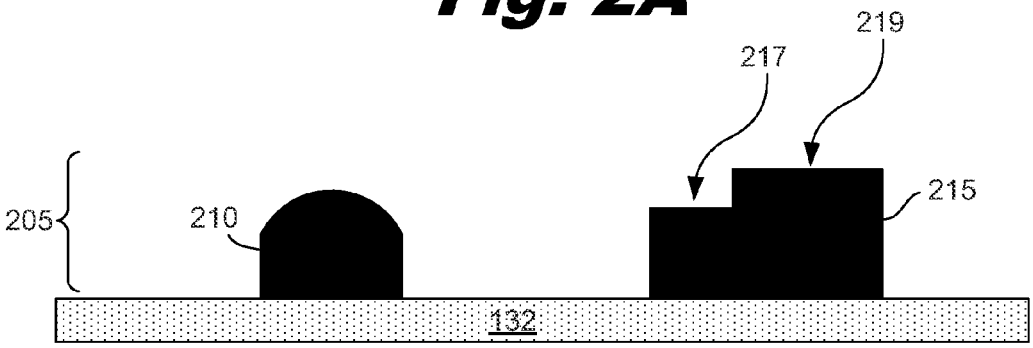

FIG. 2A is a cross sectional diagram of the impression layer (132) with several ink structures (210, 215) formed thereon. Additional ink layers are deposited to further build up the ink structures (210, 215). FIG. 2B is a cross sectional diagram of the impression layer (132) with a completed printed relief pattern (205). As discussed above, the printed relief pattern (205) may be formed from a number of ink layers. In one example, each LEP ink layer that together forms the completed printed relief pattern (205) may be approximately 0.5 to 1 micrometer (μm) in thickness. The ink structures (210, 215) may include hundreds of layers, each of which may be individually shaped to create the desired structure. In this example, a first structure (210) has a cylindrical body with a rounded top. The rounded top may be created by depositing ink layers with progressively smaller areas of ink on top of the cylindrical body. The second structure (215) has more layers than the first structure (210) and, consequently, has a higher profile than the first structure (210). Further, the second structure (215) has a terraced shape formed by depositing a series of two distinctly different shaped ink layers. The lower portion (217) of the second structure (215) is formed from ink layers with larger areas and the upper portion (219) of the structure (215) is formed by depositing ink layers with smaller areas as compared to the lower portion (217).

The ink used to form the structures (210, 215) may be any color or may have no color at all. The ink is selected so that its mechanical properties facilitate the formation of a printed relief pattern. In one example, the ink may be selected for its adhesive or structural characteristics. Different inks may be used in different layers of the structures. For example, an adhesive ink may be used as a first layer to securely bind the structures to the impression layer. The other layers may be built using inks that have more structural properties and are designed to withstand repeated compression during the embossing process.

Figure 2C:
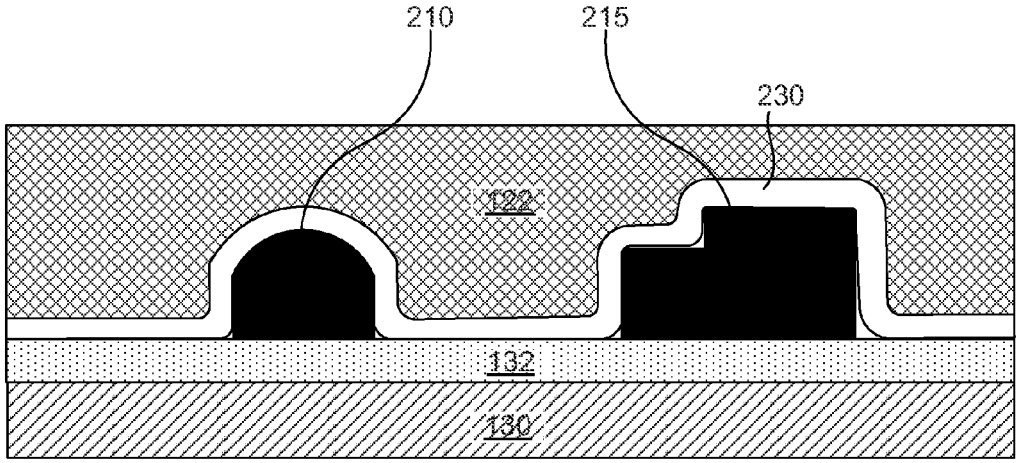
Figure 2D:
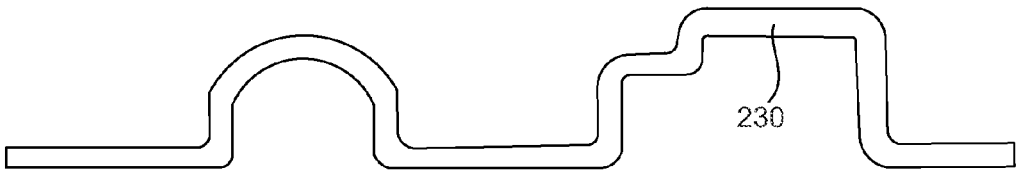

FIG. 2C shows a sheet of media (230) that has been feed between the resilient layer (122) of the blanket cylinder (120) and the impression layer (132) of the impression cylinder (130). More specifically, the sheet of media (230) has reached a point at which it is interposed between the ink structures (210, 215) of the printed relief pattern (205) and the resilient layer (122). The structures (210, 215) of the printed relief pattern are supported by the impression layer (132) and the impression cylinder (130). The sheet of media (230) is pressed against the printed relief pattern (205) by a resilient body. The resilient body could be any of a number of devices, including a compliant plate, a roller, or other suitable device. In the example of FIG. 2C, the resilient body is the resilient layer (122) of the blanket cylinder (120 FIG. 1). In the nip where the surfaces of the blanket cylinder (120 FIG. 1) and impression cylinder (130) are in closest proximity, the resilient layer (122) can exert a predetermined amount of pressure on the media (230) and force the media (230) over and into the ink structures (210, 215) which make up the printed relief pattern (205, FIG. 2B). This creates an embossed feature on the media (230) that corresponds to the underlying printed relief pattern (205, FIG. 2B). FIG. 2D shows a portion of the media (230) with an embossed feature that corresponds to the printed relief pattern (205, FIG. 2B).

The diagram shown in FIG. 2C is an example. A number of modifications could be made according to the design parameters for a particular task. For example, an adhesive layer or material could be added to increase adhesion of the ink relief pattern to the impression layer. This adhesive material may be deposited in a number of ways. For example, the printer may deposit the adhesive material on the impression layer prior to depositing the ink layers, the adhesive material may be coated onto the impression layer during manufacturing, or the adhesive material may be manually deposited on the impression layer.

Figure 3:
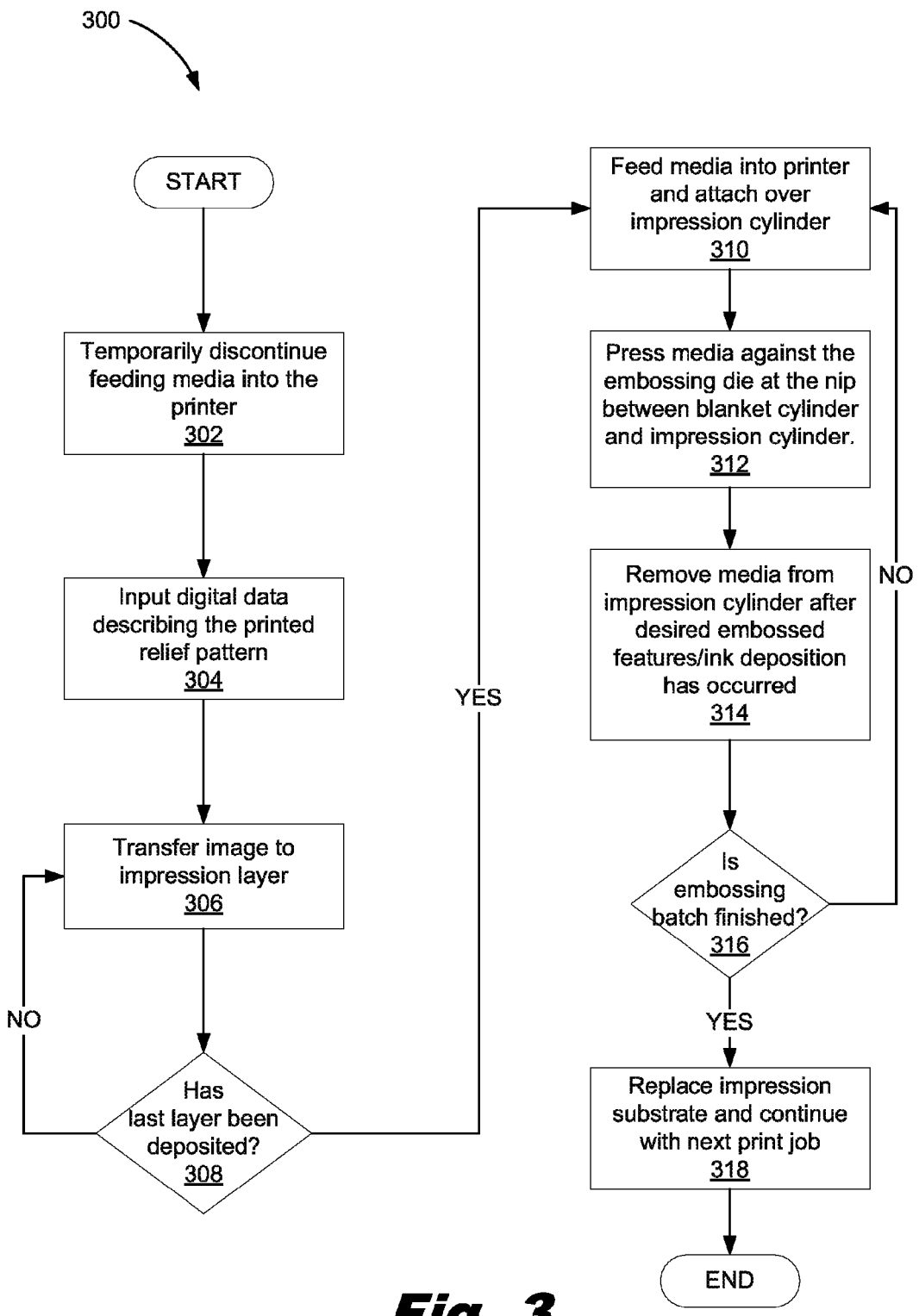
FIG. 3 is a flowchart of a method for embossing using printed relief patterns, according to one example of principles described herein.

FIG. 3 describes a method (300) for implementing digital embossing as described above in FIGS. 2A-2D on the LEP printing system (FIG. 1, 100) described in FIG. 1. The method (300) includes temporarily discontinuing the feeding of media (FIGS. 2C and 2D, 230) into the printer (FIG. 1, 100) (block 302). Digital data which describes the desired printed relief pattern (FIGS. 2A through 2C, 205, 210, 215) is input (block 304) into the printer (FIG. 1, 100). The photo-imaging cylinder (FIG. 1, 105) continues to rotate and generates an ink layer that will form the first layer of the embossing die. This image is transferred to the blanket cylinder (FIG. 1, 120) and then onto the impression layer (FIG. 1, 132) of the impression cylinder (FIG. 1, 130) (block 306). As discussed above, the impression layer (FIG. 1, 132) is wrapped around and rotates with the impression cylinder (FIG. 1, 130).

A determination is made as to whether the last layer of material has been deposited (block 308). If the last layer of material has not been deposited (block 308, determination NO), then the process loops back to block 306, where the next layer of material is deposited (block 306). The looping process defined by blocks 306 and 308 continues until the last layer has been deposited (block 308, determination YES), and the embossing die is created on the impression layer (FIG. 1, 132). In one example, the printer (FIG. 1, 100) may transfer approximately ten or more ink layers to the impression layer per second. Consequently, creating an embossing die containing hundreds of layers can be accomplished in tens of seconds. The properties of LEP inks allow deposition of printing ink layers on top of previous layers with virtually no limitation.

After the embossing die is formed, the media (FIG. 2, 230) is again fed into the printer (FIG. 1, 100) and attached over the completed printed relief pattern or embossing die (FIG. 2, 205) on the impression cylinder (block 310). A wide variety of media (FIG. 2, 230) can be used. In one example, cellulose based media ranging from 60 grams per meter square to 350 grams per meter square may be used. Other types and weights of media may be used. As each sheet of media (FIG. 2, 230) passes though the nip, it is pressed against the embossing die (FIG. 2, 205) at the nip between the blanket cylinder (FIG. 1, 120) and the impression cylinder (FIG. 1, 130) (block 312). As discussed above, this embosses the media (FIG. 2, 230) by pressing it over and into the printed relief pattern (FIG. 2, 205) which make up the embossing die. In one example, an ink image could be simultaneously printed on the media. In another example, an ink image may be formed on the media (FIG. 2, 230) before or after the above-described embossing process.

The media (FIG. 2, 230) may be retained on the impression cylinder (FIG. 1, 130) for a number of revolutions. Each time the media passes through the nip, it is again pressed over the printed relief pattern (FIG. 2, 205). For example, the impression cylinder (FIG. 1, 130) may rotate the media (FIG. 2, 230) through the nip four times before releasing the media (FIG. 2, 230). This may have a number of advantages, including sharper embossed images and an opportunity to print an image on the media (FIG. 2, 230) with four color layers. The number of passes through the nip can be adjusted according to the characteristics of a given print run.

The pressure and temperature of the blanket cylinder (FIG. 1, 120) and the impression cylinder (FIG. 1, 130) can be controlled to produce the desired embossed image. The pressure can be controlled by adjusting the distance between the two cylinders (FIG. 1, 120, 130) and/or adjusting the resiliency/thickness of the resilient layer (FIG. 1, 122). The temperature of the cylinders (FIG. 1, 120, 130) and resilient layer (FIG. 1, 122) can be adjusted by controlling heat flux into and out of the cylinders (FIG. 1, 120, 130). For example, the temperature may be increased using radiative, convective, or conducted heat. The temperature may be lowered by reducing the input heat flux or increasing a cooling convective flow.

In some examples, the printer (FIG. 1, 100) may also deposit ink on the media (FIG. 2, 230) as it is performing the embossing. The deposition of ink on the media (FIG. 2, 230) is performed as described above with respect to FIG. 1. The ink may be deposited over any region of the media (FIG. 2, 230), including areas with embossing and areas with no embossing. The embossed media (FIG. 2, 230) is removed from the impression cylinder (FIG. 1, 130) after the desired embossed features and ink deposition has occurred (block 314).

At block 316, it is determined whether the current embossing batch or run is finished. If the current embossing batch or run has not finished (block 316, determination NO), then the process loops back to block 310 where another sheet of media is fed into the printer and embossed (block 312).

Thus, the process disclosed in blocks 310 through 314 is repeated by feeding the next sheet of media (FIG. 2, 230) into the printer (FIG. 1, 100) (block 310), pressing the media (FIG. 2, 230) into the printed relief pattern (FIG. 2, 205) (block 312) and removing the media (block 314). The process continues until the embossing batch or run is complete. In one example, the embossing die (FIG. 2, 205) may be used to emboss runs that range from a single sheet of media to hundreds or thousands of sheets. Tests have shown that a single embossing die is sufficient to print at least 600 sheets of media.

If the embossing die becomes damaged or worn, the media printing/embossing process can be momentarily stopped while the printer deposits additional layers on the embossing die (FIG. 2, 205) to correct the embossing die (FIG. 2, 205). In another example, the impression layer (132) may be replaced, and the embossing die (FIG. 2, 205) can be formed on a new impression layer (132). If the current embossing batch or run has finished (block 316, determination YES), the impression layer impression layer (132) is replaced, and printing continues as usual with the next print job (block 318).

The systems and methods described above are examples of embossing using a printed relief pattern as the embossing die. As used in the specification and appended claims, the term "embossing" is used broadly to include both raised areas and depressed areas formed in a media surface.

In one example, a relief image may be created offline. As used in the specification and appended claims, the term "offline" refers to a system, printer, or process that operates independently from the embossing system. For example, the printed relief pattern (205) may be created by applying a patterned adhesive film onto the impression layer (FIG. 1, 132), using offline embossing machinery to create a printed relief pattern (205) or creating a printed relief pattern (205) on the impression layer (132) using an offline printer. The impression layer (132) may be specifically designed for this purpose.

In this example, an embossing die is formed on an impression layer (132) using an offline process. For example, an inkjet printer that deposits UV cured polymer inks or thermally curable inks may be used. The ink layers created by UV cured polymer inks can be significantly thicker than ink layers deposited by the LEP printing process. Consequently, fewer ink layers may form the desired printed relief pattern (205). The impression layer (535) may be formed from any of a number of materials, including film, plastic, poly(4,4'-oxydiphenylene-pyromellitimide) sold under the tradename KAPTON® manufactured by E.I. du Pont de Nemours and Company, or other material. In some instances, the embossing die may be formed using techniques other than ink deposition. For example, the embossing die may be created using a letter press.

In another example, an inline printer may be employed that uses a variety of technologies to deposit the printed relief pattern (205) on the impression layer (132). For example, the inline printer may be an inkjet that deposits UV curable inks onto the impression layer (132). The inline printer may include an inkjet printhead and a UV curing station. The printhead may deposit a color of UV ink or it may print a full pallet of UV inks. In one example, the inline printer may print a colorless ink onto the impression layer (132). Additionally or alliteratively, the inline inkjet printer may deposit UV curable inks directly onto the media as it passes beneath the inline inkjet printer. This can create raised or textured surfaces over or under the LEP deposited images on the media (230).

As described above, forming the printed relief pattern (FIG. 2, 205) on the impression layer (FIG. 1, 132) may, in some instances, increase the occurrence of paper jams. At block 310, when the media (FIG. 2, 230) is feed into the printer (FIG. 1, 100) after the printed relief pattern (205) has been formed on the impression layer (FIG. 1, 132), the media (FIG. 2, 230) may become affixed to the printed relief pattern (FIG. 2, 205). This may, in some instances, be due to the distance at which the printed relief pattern (FIG. 2, 205) extends from the surface of the impression layer (FIG. 1, 132). Generally, the greater the distance a printed relief pattern (FIG. 2, 205) extends from the surface of the impression layer (FIG. 1, 132), the more pressure that is placed between the media (FIG. 2, 230) and the printed relief pattern (FIG. 2, 205) during an embossing process. With this additional pressure, a number of the terminal layers of ink deposited on the impression layer (FIG. 1, 132) comprise an adhesive coefficient that is sufficiently strong enough to affix the media (FIG. 2, 230) to the printed relief pattern (FIG. 2, 205). Thus, in order to eliminate or reduce the occurrence of adhesion of the media (FIG. 2, 230) to the printed relief pattern (FIG. 2, 205), portions of the printed relief pattern (FIG. 2, 205) may be adjusted or changed.

Figure 4:
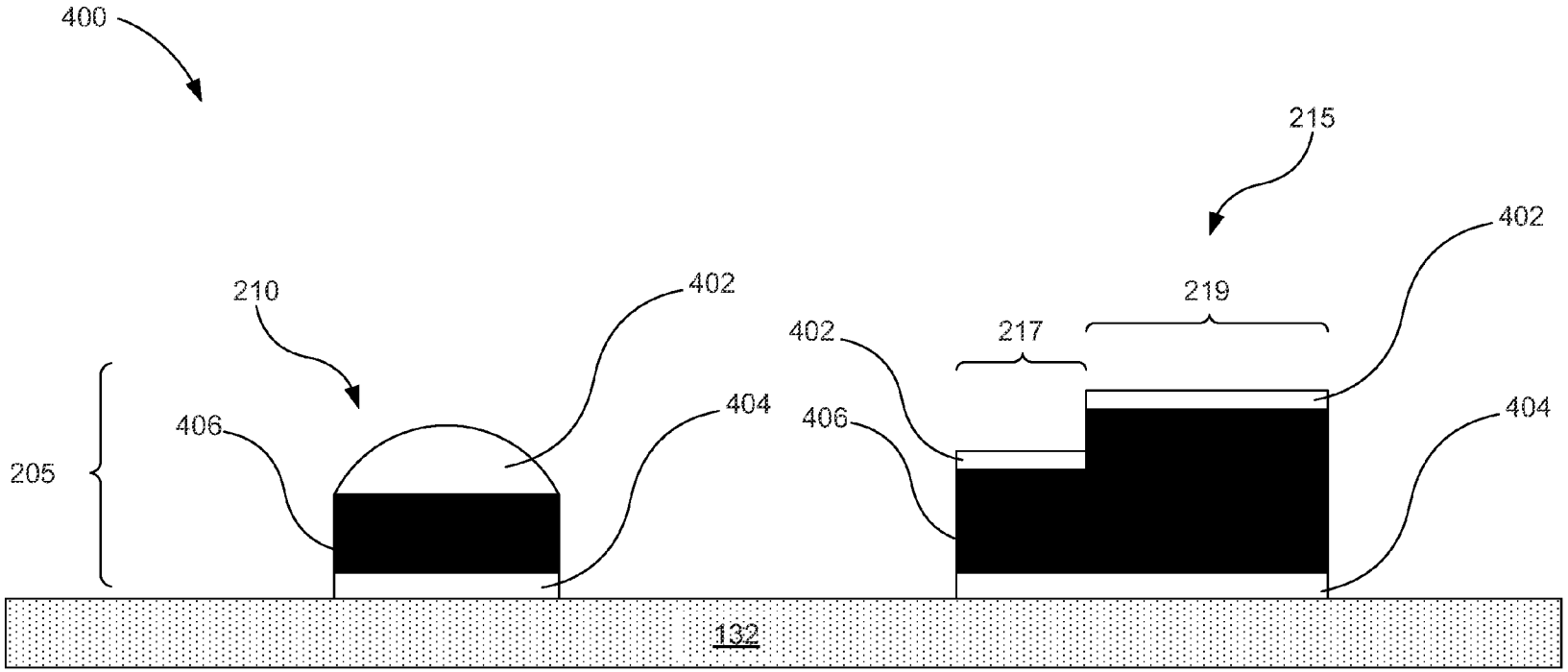
FIG. 4 is a cross sectional diagram of a printed relief pattern used as an embossing die, according to another example of principles described herein.

FIG. 4 is a cross sectional diagram of a printed relief pattern (400) used as an embossing die, according to another example of principles described herein. In the example of FIG. 4, a number of the terminal layers (402) of deposited material used to form the printed relief pattern (FIG. 2, 205) may be a material different from those already deposited. As disclosed above, different inks may be used in different layers of the printed relief pattern (FIG. 2, 205). For example, a relatively more adhesive ink may be used for a number of preliminary layers (404) to securely bind the printed relief pattern (FIG. 2, 205) to the impression layer. Intermediary layers (406) may be built using inks that have more structural properties and are designed to withstand repeated compression during the embossing process.

The terminal layers (402) of deposited material may comprise a material such as, for example, an ink that has a relatively lower adhesive coefficient than the preliminary layers (404) and intermediary layers (406). In this manner, the occurrence of affixation of the media (FIG. 2, 230) to the printed relief pattern (205) will be eliminated or reduced.

In one example, the adhesive coefficient of an ink may depend on the chemical affinity between the ink and the material on which the ink is deposited (e.g., the impression layer (132), a substrate, or other ink layers). In one example, grinding is used as a machanochemical process to encourage chemical bonding between a pigment and a number of resins within an ink composition. Thus, in one example, a yellow pigment ground in this manner may exhibit a relatively higher affinity to the substrate material on which the yellow ink is deposited.

In one example, the inks described herein are inks sold under the tradename ELECTROINK™ and are manufactured by the Hewlett-Packard Company. This ink formulation comprises toner particles dispersed in a carrier liquid, where the toner particles include a core of a polymer with fibrous extensions extending from the core. When the toner particles are dispersed in the carrier liquid in a low concentration, the particles remain separate. When the toner develops an electrostatic image, the concentration of toner particles increases and the fibrous extensions interlock.

The ink formulation comprises, for example, a carrier liquid, a resin, a colorant, and a co-resin polymer. Further, the ink formulation may include the following: a charge adjuvant, a charge director, a surface modifier, compatibility additives, charging additives, transfer additives, and combinations thereof. The carrier liquid may comprise an insulating, non-polar liquid used as the medium for toner particles. The carrier liquid may comprise compounds that have a resistivity in excess of approximately $10^9$ ohm-cm and a dielectric constant below approximately 3.0. In one example, the carrier liquid may comprise hydrocarbons. The hydrocarbon may comprise an aliphatic hydrocarbon, an isomerized aliphatic hydrocarbon, branched chain aliphatic hydrocarbons, aromatic hydrocarbons, and combinations thereof.

Examples of carrier liquids comprise aliphatic hydrocarbon, isoparaffinic compounds, paraffinic compounds, and dearomatized hydrocarbon compounds. Specific examples of carrier liquids may include ISOPAR-G™, ISOPAR-H™, ISOPAR-L™, ISOPAR-M™, ISOPAR-K™, ISOPAR V™, NORPAR 12™, NORPAR 13™, NORPAR 15™, EXXOL D40™, EXXOL D80™, EXXOL D100™, EXXOL D130™, and EXXOL D140™ all manufactured and sold by EXXON Corporation. Other examples of carrier liquids may include TECLEN N-16™, TECLEN N-20™, TECLEN N-22™, NISSEKI NAPHTHESOL L™, NISSEKI NAPHTHESOL M™, NISSEKI NAPHTHESOL H™, #0 SOLVENT L™, #0 SOLVENT M™, #0 SOLVENT H™, NISSEKI ISOSOL 300™, NISSEKI ISOSOL 400™, AF-4™, AF-5™, AF-6™ and AF-7™ all manufactured and sold by Nippon Oil Corporation. Still other examples of carrier liquids may include IP SOLVENT 1620™ and IP SOLVENT 2028™ all manufactured and sold by Idemitsu Petrochemical Co., Ltd.). Still other examples of carrier liquids may include AMSCO OMS™ and AMSCO 460™ all manufactured and sold by American Mineral Spirits Corp. Still other examples of carrier liquids may include ELECTRON™, POSITRON™, NEW II™, and PUROGEN HF™ (100% synthetic terpenes) all manufactured and sold by Ecolink. The carrier liquid is approximately 20% to 95%, approximately 40% to 90%, or approximately 60% to 80% weight of the ink formulation.

The resin may comprise thermoplastic toner resins. Examples of thermoplastic toner resins may include ethylene acid copolymers; ethylene acrylic acid copolymers; methacrylic acid copolymers; ethylene vinyl acetate copolymers; copolymers of ethylene (80% to 99.9%), acrylic, or methacrylic acid (20% to 0.1%)/alkyl (C1 to C5) ester of methacrylic or acrylic acid (0.1% to 20%); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid wherein alkyl is from: 1 to approximately 20 carbon atoms, like methyl methacrylate (50% to 90%)/methacrylic acid (0% to 20 percent/ethylhexylacrylate (10% to 50%)); ethylene-acrylate terpolymers: ethylene-acrylic esters-maleic anhydride (MAH) or glycidyl methacrylate (GMA) terpolymers; low molecular weight ethylene-acrylic acid ionomers, and combinations thereof.

In one example, the resin may include the NUCREL™ family of toners including, for example, NUCREL 403™, NUCREL 407™, NUCREL 609HS™, NUCREL 908HS™, NUCREL 1202HC™, NUCREL 30707™, NUCREL 1214™, NUCREL 903™, NUCREL 3990™, NUCREL 910™, NUCREL 925™, NUCREL 699™, NUCREL 599™, NUCREL 960™, NUCREL RX 76™, NUCREL 2806™, BYNELL 2002, BYNELL 2014, BYNELL 2020, ELVAX II 5720, ELVAX II 5610, and ELVACITE, all manufactured and sold by E.I. du Pont de Nemours and Company. In another example, the resin may include the ACLYN™ family of toners including, for example, ACLYN 201 ™, ACLYN 246™, ACLYN 285™, and ACLYN 295™, and the LOTADER™ family of toners including, for example, LOTADER 2210™, LOTADER 3430™, and LOTADER 8200™ all manufactured and sold by Arkema. The resin is approximately 5% to 80%, approximately 10% to 60%, and approximately 15% to 40% by total weight of the ink toner.

The co-resin polymer may comprise an ethylene acrylic acid co-polymer, a maleic anhydride polymer having polyethylene grafted to the polymer, and combinations thereof. Examples of the ethylene acrylic acid co-polymer include co-polymers having a DSC melting point of approximately 55 to 65, approximately 57 to 63, and approximately 60° C. Examples of the ethylene acrylic acid co-polymer include co-polymers having a melt viscosity of approximately 20,000 to 40,000, approximately 25,000 to 35,000, and approximately 30,000 cps at approximately 60° C.

Examples of the ethylene acrylic acid co-polymer include co-polymers having an acid number of approximately 150 to 250 mg KOH/gr, approximately 170 to 225 mg KOH/gr, and approximately 170 to 200 mg KOH/gr. In one example, co-resin polymer is an ethylene acrylic acid copolymer that is a random copolymer, tacky at room temperature, and non-crystalline. In another example, the ethylene acrylic acid copolymer is solid at room temperature, has a very high melt flow index (e.g., approximately 1300 gm/10 min, acc. to ASTM D-1238) and low mp (75° C.). The melt viscosity may be determined using an Advanced Rheometer AR 2000 TA Instruments Inc. In particular, approximately 3-5 grams of a sample was put between 2 plates and subjected to 10 Hz to determine the melt viscosity.

Examples of the maleic anhydride polymer having polyethylene grafted to the polymer include polymers having an acid number of approximately 25 to 45 mg KOH/gr, approximately 30 to 40 mg KOH/gr, approximately 33 to 37 mg KOH/gr, and approximately 34 mg KOH/gr. In addition, the maleic anhydride polymer has a melt viscosity approximately 4200 cps (at 140° C.) and a DSC melting point of approximately 106° C.

The colorants may comprise organic and/or inorganic colorants. In one example, the colorants may comprise cyan colorants, magenta colorants, yellow colorants, violet colorants, orange colorants, green colorants, black colorants, and combinations thereof.

Other examples of pigments include Monastral Blue G (C.I. Pigment Blue 15 C.I. No. 74160), Toluidine Red Y (C.I. Pigment Red 3), Quindo Magenta (Pigment Red 122), Indo Brilliant Scarlet toner (Pigment Red 123, C.I. No. 71145), Toluidine Red B (C.I. Pigment Red 3), Watchung Red B (C.I. Pigment Red 48), Permanent Rubine F6B13-1731 (Pigment Red 184), Hansa Yellow (Pigment Yellow 98), Dalamar Yellow (Pigment Yellow 74, C.I. No. 11741), Toluidine Yellow G (C.I. Pigment Yellow 1), Monastral Blue B (C.I. Pigment Blue 15), Monastral Green B (C.I. Pigment Green 7), Pigment Scarlet (C.I. Pigment Red 60), Auric Brown (C.I. Pigment Brown 6), Monastral Green G (Pigment Green 7), Carbon Black, and Stirling NS N-774 (Pigment Black 7, C.I. No. 77266).

In one example, the ink formulation may comprise a charge adjuvant. The charge adjuvant may include barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates such as, for example, Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate, Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethyihexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is aluminum tristearate. The charge adjuvant is approximately 0.1% to 5%, approximately 0.5% to 4%, and approximately 1% to 3% weight of the ink formulation.

The charge director can include, but is not limited to, lecithin, oil-soluble petroleum sulfonates such as, for example, neutral CALCIUM PETRONATE™, neutral BARIUM PETRONATE™, and basic BARIUM PETRONATE™, polybutylene succinimides such as, for example, OLOA™ 1200 and AMOCO 575, and glyceride salts such as, for example, sodium salts of phosphated mono- and diglycerides with unsaturated and saturated acid substituents, sulfonic acid salts including, foe example, barium, sodium, calcium, and aluminum salts of sulfonic acid. The sulfonic acids may include, for example, alkyl sulfonic acids, aryl sulfonic acids, and sulfonic acids of alkyl succinates. The charge director is approximately 0.001% to 1% weight of the ink formulation.

In one example, the preliminary layers (404) and intermediary layers (406) of the printed relief pattern (205) comprise yellow ink while the terminal layers (402) comprise black ink. Because black ink has a relatively lower adhesive coefficient than that of yellow ink as described above, affixation of the media (FIG. 2, 230) to the printed relief pattern (205) will be eliminated or reduced. In another example, the terminal layers (402) may comprise a number of inks that, alone or in combination, have a relatively lower adhesive coefficient than that of the inks used in the preliminary layers (404) and intermediary layers (406).

In yet another example, the surfaces of the ink structures (210, 215) of the printed relief pattern (205) that will come in contact with the media (230) during an embossing process comprise a material with a relatively lower adhesive coefficient than interior portions of the ink structures (210, 215). In this example, an individual layer comprises a number of different materials or inks throughout the layer so that portions of the layer that are exposed to the exterior of the ink structures (210, 215) are relatively less adhesive than another portion of the same layer. During the deposition of the above-described layers comprising a number of different materials or inks throughout the layer, an interior portion of the layer may be deposited with a first material, and an exterior portion of the same layer may then be deposited where the second material has a relatively lower adhesive coefficient than the first materials deposited at the interior portion of the layer. In this manner, affixation of the media (FIG. 2, 230) to three dimensional printed relief patterns will be eliminated or reduced.

In still another example, the terminal layers (402) of the printed relief pattern (205) may comprise a number of inks that are applied to the printed relief pattern (205) in a manner that forms a gradient of decreasing adhesive coefficient at a portion of the printed relief pattern (205). For example, a gradient of decreasing adhesiveness may be formed the further a particular layer gets from the impression layer (132) and closer to the top of the ink structures (210, 215). In this example, the gradient of adhesive coefficient eliminates or reduces the affixation of the media (FIG. 2, 230) to the printed relief pattern (205) while still ensuring that the printed relief pattern (205) is strong enough to withstand pressure exerted between the media (FIG. 2, 230) and the printed relief pattern (205). Thus, the printed relief pattern (205) remains intact and undamaged, while eliminating or reducing affixation of the media (FIG. 2, 230) to the printed relief patterns.

In still another example, the above described gradient may exist in the direction of the x-axis, the y-axis, the z-axis, or combinations thereof. For example, the adhesive gradient may exist throughout the hemisphere formed within the top of the first structure (210) so that the top of the hemisphere has a relatively lower adhesive coefficient than lower portions of the hemisphere. Similarly, the gradient may exist between the lower portion (217) and the upper portion (219) of structure (215) so that the ink deposited on the upper portion (219) has a relatively lower adhesive coefficient than the lower portion (217).

In still another example, a number of layers within the printed relief pattern (205) may have their own respective gradient of adhesive coefficient. In this example, an individual layer may incorporate a number of inks throughout the layer that cause one portion of the layer to be relatively less adhesive than another portion of the same layer.

In still another example, a gradient of decreasing adhesive coefficient may exist within the ink structures (210, 215) of the printed relief pattern (205) in a manner that the surfaces of the ink structures (210, 215) has a relatively lower adhesive coefficient than interior portions of the ink structures (210, 215). In this example, the surfaces of the ink structures (210, 215) of the printed relief pattern (205) that will come in contact with the media (230) during an embossing process comprise a material with a relatively lower adhesive coefficient than interior portions of the ink structures (210, 215), and a gradient of adhesive coefficient is formed between the interior and exterior of the ink structures (210, 215). In this example, the gradient of adhesive coefficient eliminates or reduces the affixation of the media (FIG. 2, 230) to the printed relief pattern (205) while still ensuring that the printed relief pattern (205) is strong enough to withstand pressure exerted between the media (FIG. 2, 230) and the printed relief pattern (205). Thus, the printed relief pattern (205) remains intact and undamaged, while eliminating or reducing affixation of the media (FIG. 2, 230) to the printed relief patterns.

Figure 5:
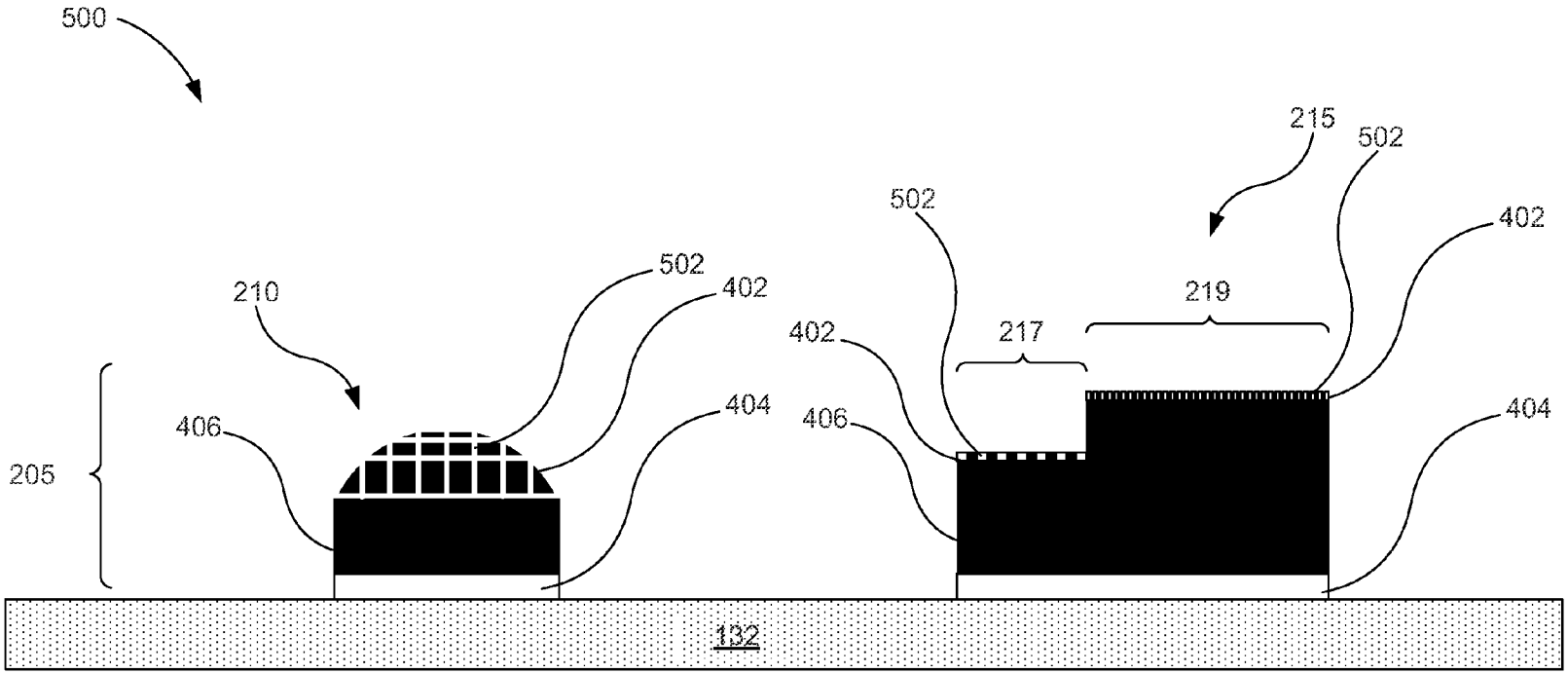
FIG. 5 is a cross sectional diagram of a printed relief pattern used as an embossing die, according to still another example of principles described herein.

FIG. 5 is a cross sectional diagram of a printed relief pattern used as an embossing die, according to still another example of principles described herein. In the example of FIG. 5, a pattern (502) is formed in the terminal layers (402) of the printed relief pattern (205). In one example, the pattern (502) comprises the same material or ink deposited in the underlying layers. In this example, the material deposited in a pattern on the surface of the ink structures (210, 215) forms a non-uniform surface or texture on the ink structures (210, 215). This textured surface allows for media (FIG. 2, 230) that is brought into contact with the printed relief pattern (205) to release from the printed relief pattern (205). This eliminates or reduces affixation of the media (FIG. 2, 230) to the printed relief pattern (205).

In another example, the pattern (502) comprises a material such as, for example, an ink with a relatively lower adhesive coefficient than the material or ink that forms the underlying layers. In this example, the pattern (502) forms a non-uniform surface or texture on the ink structures (210, 215) as described in the above example, and further provides an interface between the media (FIG. 2, 230) and the printed relief pattern (205) that has a relatively lower adhesive coefficient than the underlying layers of material. In this example, the textured surface comprising, in part, a material having a relatively lower adhesive coefficient than the underlying layers of material allows for media (FIG. 2, 230) that is brought into contact with the printed relief pattern (205) to release from the printed relief pattern (205). This eliminates or reduces affixation of the media (FIG. 2, 230) to the printed relief pattern (205).

In the above example, the pattern (502) may be disposed on a portion of or all surfaces of the ink structures (210, 215) of the printed relief pattern (205). In one example where the pattern (502) is disposed on a portion of the ink structures (210, 215), the portion on which the pattern (502) is disposed may be those portions of the ink structures (210, 215) that come into contact with the media (FIG. 2, 230) during an embossing process.

The pattern (502) depicted in FIG. 5 is a pattern of lines that run over the surfaces of the ink structures (210, 215) of the printed relief pattern (205). However, a pattern (502) of any design may be formed on the underlying layers including, for example, a pattern of dots, concentric circles, perpendicular lines or other patterns. In another example, the pattern (502) may comprise abstract formations of ink with a relatively lower adhesive coefficient than the material or ink that forms the underlying layers. The example of FIG. 5 breaks up the otherwise generally smooth surface of the upper layers of the printed relief pattern (205), and prevents those upper surfaces from adhering or affixing to the media (230). This, in turn, eliminates or reduces paper jams that may otherwise occur if the pattern (502) was not formed on the ink structures (210, 215) of the printed relief pattern (205).

In another example, the pattern (502) is formed on the surfaces of the ink structures (210, 215) of the printed relief pattern (205) that will contact the media (230) during an embossing process. In this example, the pattern (502) of material comprising a relatively lower adhesive coefficient than the underlying layers of ink are formed on portions of the number of layers that are exposed to the exterior of the ink structures (210, 215). In this manner, affixation of the media (FIG. 2, 230) to three dimensional printed relief patterns will be eliminated or reduced.

In yet another example, the density of pattern (502) that is formed on the surfaces of the ink structures (210, 215) of the printed relief pattern (205) is dependent on the distance at which the printed relief pattern (FIG. 2, 205) extends from the surface of the impression layer (FIG. 1, 132). For example, referring to second structure (215), FIG. 5 depicts a relatively higher density of pattern (502) formed on the upper portion (219) of the structure (215) as compared to the lower portion (217). Because the upper portion (219) is relatively further from the impression layer (132), affixation of the media (FIG. 2, 230) to the upper portion (219) may be relatively more prevalent that that experienced by the lower portion (217). Therefore, by including a relatively denser pattern (502) on the upper portion (219) of the structure (215) as compared to the lower portion (217), affixation of the media (FIG. 2, 230) to the ink structures (210, 215) of the printed relief pattern (205) will be eliminated or reduced. In another example, the density of pattern (502) that is formed on the surfaces of the ink structures (210, 215) of the printed relief pattern (205) is different at different portions of the printed relief pattern (FIG. 2, 205) independent of the distance at which those portions of the printed relief pattern (FIG. 2, 205) extend from the surface of the impression layer (FIG. 1, 132).

In still another example, the density of the pattern (502) formed on the various features of the ink structures (210, 215) may be formed as a density gradient. In this example, a gradient in density of the pattern (502) is formed on the surfaces of the ink structures (210, 215) depending on the distance at which the printed relief pattern (FIG. 2, 205) extends from the surface of the impression layer (FIG. 1, 132). Thus, the density of the pattern (502) increases in a gradient manner as the distance at which that portion of the printed relief pattern (FIG. 2, 205) extends from the surface of the impression layer (FIG. 1, 132) increases. For example, as depicted in FIG. 5, the first structure (210) comprises a hemispherical top with a surface that has a gradually increasing distance from the surface of the impression layer (FIG. 1, 132). Thus, the density of the pattern (502) increases in a gradient manner towards the top of the first structure (210). Therefore, by including a relatively denser pattern (502) on the upper portion (219) of the structure (215) as compared to the lower portion (217), affixation of the media (FIG. 2, 230) to the ink structures (210, 215) of the printed relief pattern (205) will be eliminated or reduced.

Figure 6:
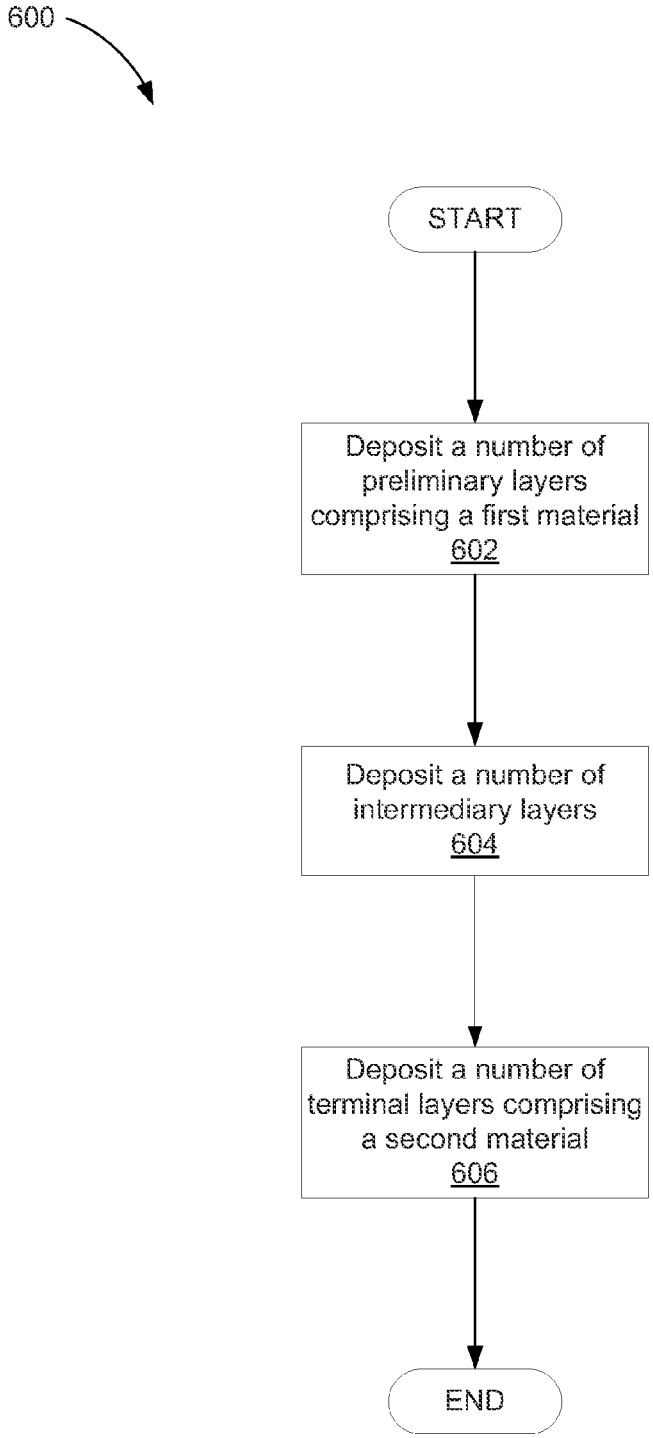
FIG. 6 is a flowchart of a method for forming a printed relief pattern on an impression layer for media embossing, according to one example of principles described herein.

FIG. 6 is a flowchart (600) of a method for forming a printed relief pattern (205) on an impression layer (132) for media embossing, according to one example of principles described herein. The method may begin by depositing (block 602) a number of preliminary layers (404) on the impression layer (FIG. 1, 132). As described above, the preliminary layers (404) comprise a first material such, for example, a first ink. At block 604, a number of intermediary layers (406) are then deposited on the preliminary layers (404). A number of terminal layers (402) comprising a second material such as, for example, a second ink, are deposited (block 606). As described above, the second material has a relatively lower adhesive coefficient than the first material. In one example, where the first and second materials are inks, the first ink may be, for example, a yellow ink, and the second ink may be, for example, a black ink. As described above, black ink has a relatively lower adhesive coefficient than yellow ink. In this manner, affixation of the media (FIG. 2, 230) to the ink structures (210, 215) of the printed relief pattern (205) during the above embossing processes will be eliminated or reduced.

Figure 7:
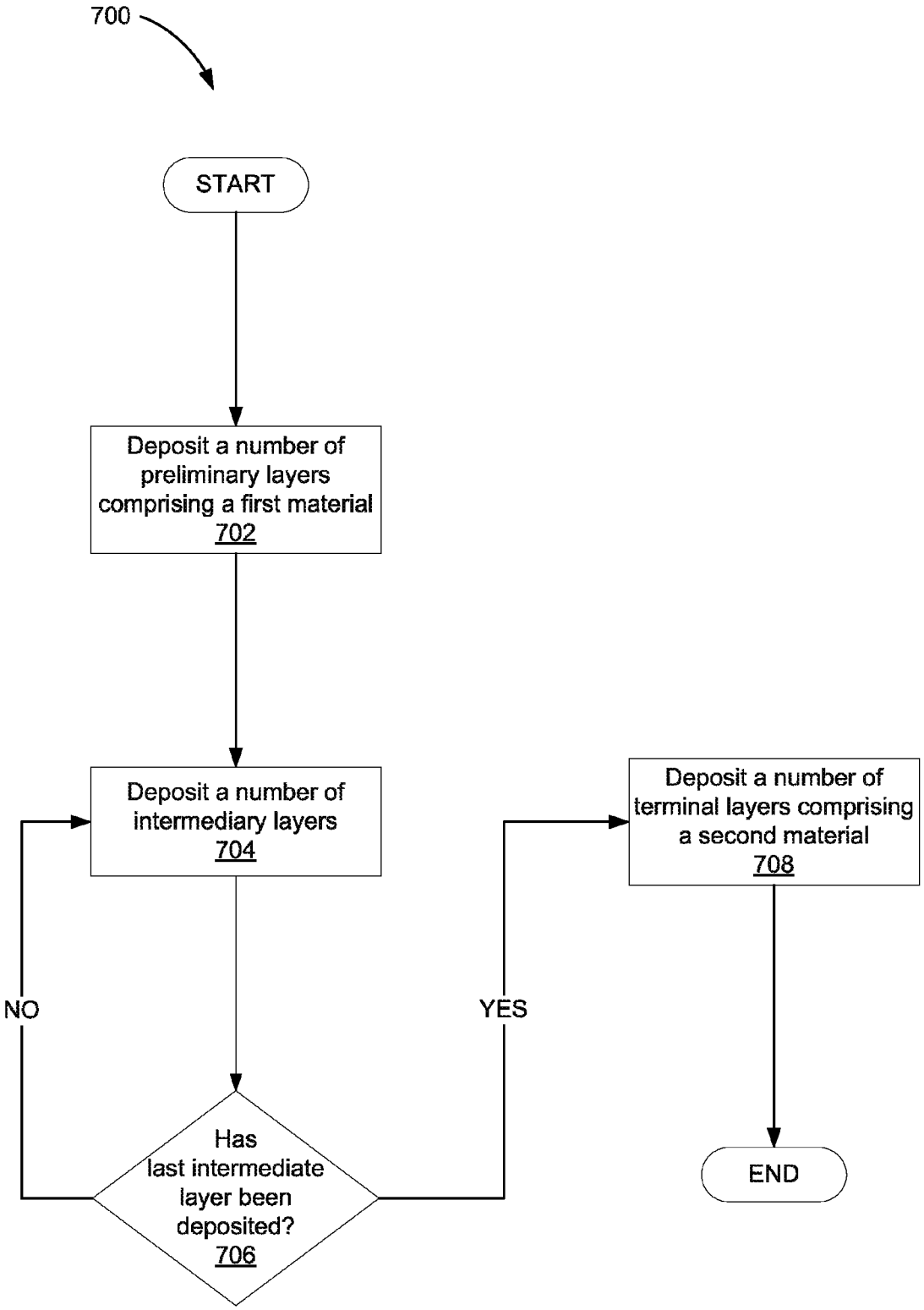
FIG. 7 is a flowchart of a method for forming a printed relief pattern on an impression layer for media embossing, according to another example of principles described herein.

FIG. 7 is a flowchart (700) of a method for forming a printed relief pattern (205) on an impression layer (132) for media embossing, according to another example of principles described herein. The method may begin by depositing (block 702) a number of preliminary layers (404) on the impression layer (FIG. 1, 132). As described above, the preliminary layers (404) comprise a first material such, for example, a first ink. At block 704, a number of intermediary layers (406) are then deposited on the preliminary layers (404). A determination (block 706) as to whether the last intermediary layer has been deposited is then made. If the last intermediary layer has not been deposited (block 706, determination NO), then the process loops back to block 704 where another intermediary layer is deposited.

If, however, the last intermediary layer has not been deposited (block 706, determination NO), then the method (700) moves to block 708. Determination as to whether a last intermediary layer has or has not been deposited depends on how much of a second material is to be deposited on or within the ink structures (210, 215) of the printed relief pattern (205). For example, any number of terminal layers (402) comprising the second material with a relatively lower adhesive coefficient than the first material or the material from which the intermediary layers are made may be printed on the printed relief pattern (205). In another example, described in connection with the example of FIG. 5, a pattern of the terminal layers (402) comprising the second material with a relatively lower adhesive coefficient than the first material or the material from which the intermediary layers are made may be printed on the printed relief pattern (205). Based on the above, the number of intermediary layers may increase or decrease depending on the desired adhesive coefficient of the outer surfaces of the printed relief pattern (205).

A number of terminal layers (402) comprising a second material such as, for example, a second ink, are deposited (block 708). As described above, the second material has a relatively lower adhesive coefficient than the first material. In one example, where the first and second materials are inks, the first ink may be, for example, a yellow ink, and the second ink may be, for example, a black ink. Further, as described above, black ink has a relatively lower adhesive coefficient than yellow ink. In this manner, affixation of the media (FIG. 2, 230) to the ink structures (210, 215) of the printed relief pattern (205) during the above embossing processes will be eliminated or reduced.

The specification and figures describe a system and method of forming a printed relief pattern for embossing media. The printed relief pattern comprises a number of preliminary layers, the preliminary layers comprising a first material, and a number of terminal layers, the terminal layers comprising a second material, in which the second material has a lower adhesive coefficient than the first material. This printed relief pattern may have a number of advantages, including, for example, elimination or reduction of affixation of media to ink structures of the printed relief pattern during an embossing process.

The preceding description has been presented to illustrate and describe examples of the principles described. This description is not intended to be exhaustive or to limit these principles to any precise form disclosed. Many modifications and variations are possible in light of the above teaching.

What is claimed is:

1. An embossing system comprising:

an input for receiving digital data defining a relief pattern for embossing;

an impression cylinder;

a developer configured to dispense material according to the digital data to a surface of the impression cylinder to form the relief pattern directly on the surface of the impression cylinder;

a print media feeding system comprising a nip for pressing print media against the relief pattern on the impression cylinder to emboss the print media; and a controller to:

cause the developer to form the relief pattern directly on the surface of the impression cylinder based on the digital data; and cause the print media feeding system to press the print media against the relief pattern, directly on the surface of the impression cylinder, to emboss the print media.

2. The system of claim 1, wherein the material dispensed by the developer comprises ink.

3. The system of claim 2, wherein the input is also configured to receive print data defining an image to be printed in ink on print media, the developer configured to form the image for transfer to print media.

4. The system of claim 3, wherein the developer forms the image on a photo-imaging cylinder.

5. The system of claim 4, wherein the developer forms successive layers of the relief pattern on the photo-imaging cylinder, with each successive layer being transferred to the impression cylinder to form the relief pattern on the impression cylinder.

6. The system of claim 5, further comprising a blanket cylinder for transferring both printed images and layers of the relief pattern from the photo-imaging cylinder to the impression cylinder.

7. The system of claim 3, wherein the print media feeding system is configured to recirculate a single sheet of print media for both embossing the sheet with the relief pattern and transferring an ink image to the sheet.

8. The system of claim 1, wherein the print media feeding system temporarily ceases feeding print media through the system while the relief pattern is formed on the impression cylinder by the developer.

9. The system of claim 1, further comprising an adhesive layer on the impression cylinder to increase adhesion of the relief pattern.

10. The system of claim 1, wherein the print media feeding system passes a single sheet of print media through the nip multiple times to emboss the relief pattern into the sheet of print media.

11. The system of claim 1, wherein the impression cylinder is heated to promote embossing of the print media.

12. The system of claim 1, further comprising a curing station for curing the material forming the relief pattern on the impression cylinder.

13. A method of embossing print media, the method comprising:

forming successive layers of a relief pattern with a developer configured to dispense material so as to build up the relief pattern based on digital data defining the relief pattern, the relief pattern being formed directly on an impression cylinder; and feeding print media through a nip for pressing the print media against the relief pattern to form both raised areas and depressed areas in the print media surface with the relief pattern.

14. The method of claim 13, wherein the material used to build the relief pattern comprises ink.

15. The method of claim 13, further comprising passing a single sheet of print media through the nip multiple times to emboss the relief pattern into the sheet of print media.

16. The method of claim 13, further comprising curing the material forming the relief pattern.

17. The method of claim 13, further comprising repairing the relief pattern by depositing more material with the developer.

18. The method of claim 13, further comprising:

forming an ink image with the developer; and transferring the ink image to the print media to produce a printed and embossed sheet of print media.

19. The method of claim 13, further comprising using at least two different materials dispensed by the developer to form the relief pattern.

20. The method of claim 19, wherein top portions of the relief pattern for contact with print media are formed of a less adhesive material than a second material used to form other portions of the relief pattern.

* * * * *